US006939200B2

(12) United States Patent
Beaucage et al.

(10) Patent No.: US 6,939,200 B2
(45) Date of Patent: Sep. 6, 2005

(54) METHOD OF PREDICTING PLATE LAPPING PROPERTIES TO IMPROVE SLIDER FABRICATION YIELD

(75) Inventors: Jacey Robert Beaucage, San Jose, CA (US); Paul Arthur Goddu, San Jose, CA (US); Huey-Ming Tzeng, San Jose, CA (US)

(73) Assignee: Hitachi Global Storage Technologies Netherlands B.V., Amsterdam (NL)

( * ) Notice: Subject to any disclaimer, the term of this patent is extended or adjusted under 35 U.S.C. 154(b) by 0 days.

(21) Appl. No.: 10/663,606

(22) Filed: Sep. 16, 2003

(65) Prior Publication Data

US 2005/0059322 A1 Mar. 17, 2005

(51) Int. Cl.[7] ..... B49D 1/00

(52) U.S. Cl. ..... 451/5; 451/8; 451/9; 451/10; 451/11; 451/41; 451/285; 451/286; 451/287; 451/288; 451/364

(58) Field of Search ..... 451/5, 8, 9, 10, 451/11, 41, 285, 286, 287, 288, 364

(56) References Cited

U.S. PATENT DOCUMENTS

| | | | | |
|---|---|---|---|---|
| 4,910,155 | A | | 3/1990 | Cote et al. |
| 5,738,562 | A | | 4/1998 | Doan et al. |
| 5,743,784 | A | | 4/1998 | Birang et al. |
| 5,948,205 | A | | 9/1999 | Kodera et al. |
| 5,985,093 | A | | 11/1999 | Chen |
| 6,074,283 | A | | 6/2000 | Maeda et al. |
| 6,095,908 | A | | 8/2000 | Torii |
| 6,217,412 | B1 | | 4/2001 | Campbell et al. |
| 6,257,953 | B1 | | 7/2001 | Gitis et al. |
| 6,293,139 | B1 | | 9/2001 | Keller et al. |
| 6,347,975 | B2 | | 2/2002 | Ishizaki et al. |
| 6,374,479 | B1 | | 4/2002 | Sasaki et al. |
| 6,395,634 | B1 | * | 5/2002 | Miyamoto ..... 438/691 |
| 6,439,964 | B1 | | 8/2002 | Prahbu et al. |
| 6,494,765 | B2 | | 12/2002 | Gitis et al. |
| 6,531,399 | B2 | * | 3/2003 | Kojima et al. ..... 438/692 |
| 6,594,542 | B1 | | 7/2003 | Williams |
| 6,736,992 | B2 | * | 5/2004 | Zhang et al. ..... 252/79.1 |
| 6,739,947 | B1 | * | 5/2004 | Molnar ..... 451/8 |
| 2001/0007809 | A1 | | 7/2001 | Mitsuhashi |
| 2002/0052166 | A1 | | 5/2002 | Kojima et al. |
| 2002/0106971 | A1 | | 8/2002 | Rodriquez et al. |

FOREIGN PATENT DOCUMENTS

| | | |
|---|---|---|
| JP | 58192747 | 11/1983 |
| JP | 61025766 | 2/1986 |
| JP | 1045568 | 2/1989 |
| JP | 2001030157 | 2/2001 |
| JP | 2003071708 | 3/2003 |

* cited by examiner

*Primary Examiner*—Joseph J. Hail, III
*Assistant Examiner*—Shantese L. McDonald
(74) *Attorney, Agent, or Firm*—Bracewell & Giuliani LLP

(57) ABSTRACT

A method of predicting the lapping property of a charged lapping plate uses samples with a known lap surface. The samples are lapped on the plate and a non-invasive sensor is used to determine the lapping rate under a fixed load and rotation speed. The total frictional force of the samples is measured during the lapping to calculate the friction and Preston coefficients of the plate. The samples are held in place while the plate rotates and the sensor measures the distance to the plate. The plate rotates for a specific time so that adequate removal of the pad material has occurred. The lapping rate is determined from a change in the gap distance over a time interval. The lapping rate and friction are then assessed to determine if the plate is lapping worthy.

12 Claims, 1 Drawing Sheet

METHOD OF PREDICTING PLATE LAPPING PROPERTIES TO IMPROVE SLIDER FABRICATION YIELD

BACKGROUND OF THE INVENTION

1. Technical Field

The present invention relates in general to an improved method of testing lapping plates and, in particular, to an improved method of predicting the lapping properties of a lapping plate in order to improve its slider fabrication yield.

2. Description of the Related Art

Magnetic recording is employed for large memory capacity requirements in high speed data processing systems. For example, in magnetic disc drive systems, data is read from and written to magnetic recording media utilizing magnetic transducers commonly referred to as magnetic heads. Typically, one or more magnetic recording discs are mounted on a spindle such that the disc can rotate to permit the magnetic head mounted on a moveable arm in position closely adjacent to the disc surface to read or write information thereon.

During operation of the disc drive system, an actuator mechanism moves the magnetic transducer to a desired radial position on the surface of the rotating disc where the head electromagnetically reads or writes data. Usually the head is integrally mounted in a carrier or support referred to as a "slider." A slider generally serves to mechanically support the head and any electrical connections between the head and the rest of the disc drive system. The slider is aerodynamically shaped to slide over moving air and therefore to maintain a uniform distance from the surface of the rotating disc thereby preventing the head from undesirably contacting the disc.

Typically, a slider is formed with essentially planar areas surrounded by recessed areas etched back from the original surface. The surface of the planar areas that glide over the disc surface during operation is known as the air bearing surface (ABS). Large numbers of sliders are fabricated from a single wafer having rows of the magnetic transducers deposited simultaneously on the wafer surface using semiconductor-type process methods. After deposition of the heads is complete, single-row bars are sliced from the wafer, each bar comprising a row of units which can be further processed into sliders having one or more magnetic transducers on their end faces. Each row bar is bonded to a fixture or tool where the bar is processed and then further diced, i.e., separated into sliders having one or more magnetic transducers on their end faces. Each row bar is bonded to a fixture or tool where the bar is processed and then further diced, i.e., separated into individual sliders each slider having at least one magnetic head terminating at the slider air bearing surface.

The slider head is typically an inductive electromagnetic device including magnetic pole pieces, which read the data from or write the data onto the recording media surface. In other applications the magnetic head may include a magneto resistive read element for separately reading the recorded data with the inductive heads serving only to write the data. In either application, the various elements terminate on the air bearing surface and function to electromagnetically interact with the data contained on the magnetic recording disc.

In order to achieve maximum efficiency from the magnetic heads, the sensing elements must have precision dimensional relationships to each other as well as the application of the slider air bearing surface to the magnetic recording disc. Each head has a polished ABS with flatness parameters, such as crown, camber, and twist. The ABS allows the head to "fly" above the surface of its respective spinning disk. In order to achieve the desired fly height, fly height variance, take-off speed, and other aerodynamic characteristics, the flatness parameters of the ABS need to be tightly controlled. During manufacturing, it is most critical to grind or lap these elements to very close tolerances of desired flatness in order to achieve the unimpaired functionality required of sliders.

Conventional lapping processes utilize either oscillatory or rotary motion of the workpiece across either a rotating or oscillating lapping plate to provide a random motion of the workpiece over the lapping plate and randomize plate imperfections across the head surface in the course of lapping. During the lapping process, the motion of abrasive particles carried on the surface of the lapping plate is typically along, parallel to, or across the magnetic head elements exposed at the slider ABS.

In magnetic head applications, the electrically active components exposed at the ABS are made of relatively softer, ductile materials. These electrically active components during lapping can scratch and smear into the other components causing electrical shorts and degraded head performance. The prior art lapping processes cause different materials exposed at the slider ABS to lap to different depths, resulting in recession or protrusion of the critical head elements relative to the air bearing surface. As a result, poor head performance because of increased space between the critical elements and the recording disc can occur.

Rotating lapping plates having horizontal lapping surfaces in which abrasive particles such as diamond fragments are embedded have been used for lapping and polishing purposes in the high precision lapping of magnetic transducing heads. Generally in these lapping processes, as abrasive slurry utilizing a liquid carrier containing diamond fragments or other abrasive particles is applied to the lapping surface as the lapping plate is rotated relative to the slider or sliders maintained against the lapping surface.

Although a number of processing steps are required to manufacture heads, the ABS flatness parameters are primarily determined during the final lapping process. The final lapping process may be performed on the heads after they have been separated or segmented into individual pieces, or on rows of heads prior to the segmentation step. This process requires the head or row to be restrained while an abrasive plate of specified curvature is rubbed against it. As the plate abrades the surface of the head, the abrasion process causes material removal on the head ABS and, in the optimum case, will cause the ABS to conform to the contour or curvature of the plate. The final lapping process also creates and defines the proper magnetic read sensor and write element material heights needed for magnetic recording.

There are a number of factors that affect the accuracy of ABS curvature during the final lapping process. These include diamond size/morphology, lubricant chemistry, lapping surface velocity, plate material, lapping motion/path on the plate, and other lapping parameters. In addition to these parameters, another critical condition must be satisfied. It is essential that the contour of the abrasive plate be tightly controlled since, in the best case, the ABS will conform to the curvature of the plate. Thus, the flatness of the slider ABS exhibits a strong dependency on the lapping plate used. For a given plate, the lapping property of the plate changes every time the plate is refaced and recharged. It is known in the trade that a so-called "good plate" is key to achieve good slider flatness. Likewise, it is not uncommon to see a so-called "bad plate" cause unacceptable sliders. Consequently, it would be highly desirable to be able to predict the lapping property of a lapping plate after it is charged so that the status of the plate can be assessed.

SUMMARY OF THE INVENTION

One embodiment of a method of predicting the lapping property of a lapping plate uses one or more samples with a known lap surface. The samples are lapped on the plate, which is charged with abrasives. A non-invasive sensor is used to determine the lapping rate under a fixed load and fixed plate rotation speed. The total frictional force of the samples is measured during the lapping. Under these conditions, various properties of the plate such as the friction coefficient and the Preston coefficient, lapping rate normalized by the applied force, can be calculated.

A good lapping plate is expected to have relatively high friction and Preston coefficients for a given abrasive and plate matrix. A high friction coefficient and a low Preston coefficient indicate that the plate does not have enough abrasive embedded in the plate. In contrast, a low friction coefficient and a high Preston coefficient indicate that the plate has been excessively charged, has too many scratches, or has an abrasive size that is too large for the set conditions.

In one version of the present invention, three ceramic pads are used and formed from the same material as the sliders. The pads are attached to a holder, which is positioned on the charged lapping plate. A weight is added to the top of the holder so that the pads experience the same pressure as that of the sliders during lapping. A set of guide wheels keep the holder in place when the plate is rotating. The guide wheels and a strain gage are mounted to a stationary arm. The strain gage measures the total friction force when the plate is turning.

A distance sensor is located in the center of the holder to measure a gap distance between the distance sensor and the plate. In one embodiment, the distance sensor may comprise an inductive distance sensor, such as the Kaman Model 15N, which has a sensitivity of 100 nm for a 10 mV sensor output. The plate rotates for a specific time so that adequate removal of the pad material has occurred. The lapping rate is determined from a change in the gap distance over a time interval. The lapping rate and friction force are then assessed to determine if the plate is lapping worthy. In addition, the sample may be made of the same material as the lap piece, such as N58 ceramic, to predict the lapping rate of the plate. The processed plate lapping rate and force measurements determine if adequate charging of a plate has been achieved.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the invention, as well as others which will become apparent are attained and can be understood in more detail, more particular description of the invention briefly summarized above may be had by reference to the embodiment thereof which is illustrated in the appended drawings, which drawings form a part of this specification. It is to be noted, however, that the drawings illustrate only an embodiment of the invention and therefore are not to be considered limiting of its scope as the invention may admit to other equally effective embodiments.

DETAILED DESCRIPTION OF THE INVENTION

Figure 1:
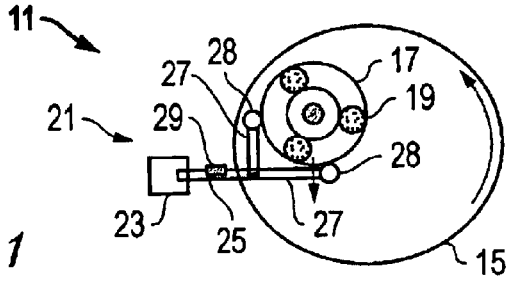
FIG. 1 is a schematic diagram of one embodiment of a device for predicting lapping properties of plates and is constructed in accordance with the present invention.
Figure 2:
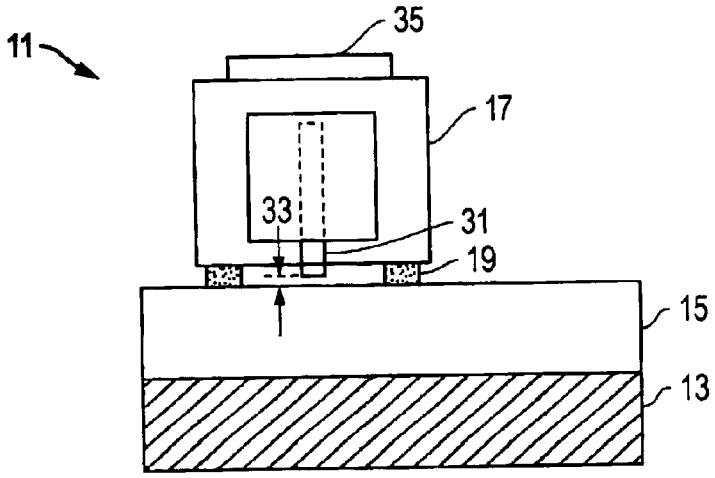
FIG. 2 is a sectional side view of the device of FIG. 1.

Referring to FIGS. 1 and 2, one embodiment of the present invention for predicting the lapping property of a lapping plate is depicted. The invention utilizes a tool 11 having several components. A rotatable platform 13 is provided for supporting and rotating a lapping plate 15. The lapping plate 15 is typically mounted on top of the rotatable platform 13 for rotation therewith. The tool 11 comprises a holder 17 having a specimen 19 (three shown) mounted thereto and positioned on top of the lapping plate 15. The holder 17 itself does not contact the lapping plate 15. Only the specimens 19 make contact with the lapping plate 15, as shown in FIG. 2. The system is well suited for predicting the lapping property of a lapping plate that is charged with abrasive. The specimen 19 may be formed from a material used to fabricate sliders.

A fixture 21 is positioned adjacent to the lapping plate 15, as shown in FIG. 1. The fixture 21 has a stationary base 23, an arm 25 mounted to and extending away from the base 23 toward the lapping plate 15. The fixture also includes a guide feature 27 mounted to and protruding from the arm 25 for contacting and, in the embodiment shown, horizontally supporting the holder 17 with respect to the rotating lapping plate 15. The guide feature 27 may comprise a set of guide wheels 28 that keep the holder 17 in place when the lapping plate 15 is rotating.

In addition, the fixture 21 utilizes a friction detection means 29 that is mounted to the fixture 21 for measuring frictional force between the lapping plate 15 and the specimen 19. The friction detection means 29 is mounted to the arm in the version shown, and may comprise a strain gage. The fixture 21 also has a distance sensor 31 that, in the embodiment shown, is mounted to the holder 17 for detecting a vertical gap distance 33 between the distance sensor 31 and the lapping plate 15. The distance sensor 31 is preferably a non-invasive sensor, such as an inductive distance sensor having a sensitivity of approximately 100 nm for a 10 mV sensor output. In the embodiment shown, the specimens 19 are symmetrically spaced apart about the distance sensor 31.

The lapping plate 15 is required to rotate for a specific time so that adequate removal of material from the specimen 19 occurs. A lapping rate of the lapping plate 15 is determined from a change in the gap distance 33 over a time interval. The lapping rate and friction force are then assessed to determine if the lapping plate 15 is acceptable. In one embodiment, the system determines the lapping rate of the lapping plate 15 under a fixed load and a fixed rotation speed, such that a coefficient of friction and a Preston coefficient of the lapping plate 15 can be calculated. The fixed load may be defined by placing a weight 35 on top of the holder 17 so that the specimen 19 and the lapping plate 15 experience a pressure that is analogous to a slider lapping pressure.

Figure 3:
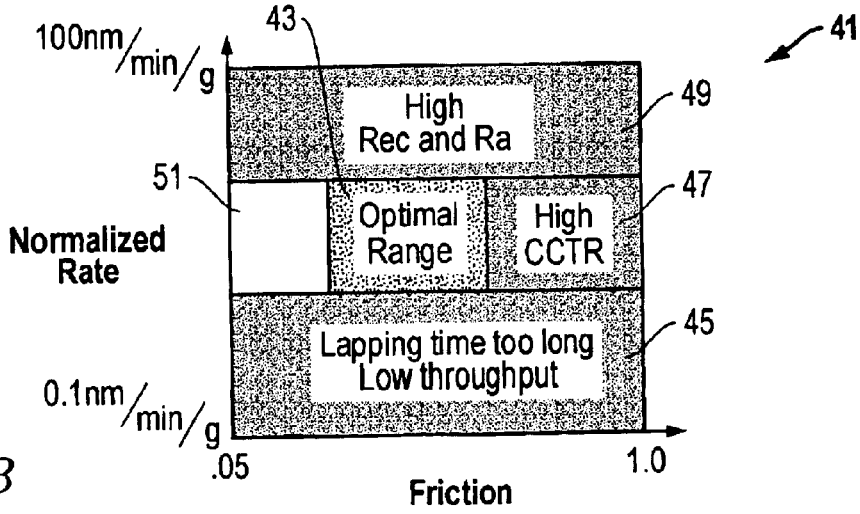
FIG. 3 is a plot of frictional force versus lapping rates for lapping plates.

Referring now to FIG. 3, a plot 41 of various ranges of performance of lapping plates is shown. The x-axis represents the coefficient of friction of lapping plates, and the y-axis represents the force-normalized lapping rate of lapping plates. Plot 41 compares lapping rate and friction to assess if a lapping plate is lapping worthy. Ideally, a lapping plate will perform in the optimal range 43 indicated near the center of plot 41. Range 43 has a coefficient of friction that is greater than 0.05 and less than 1.0, and a lapping rate that is greater than 0.1 nm/min/g and less than 100 nm/min/g. Lapping plates that perform in area 45 have low throughput and excessive lapping times. Lapping plates that perform in area 47 have high crown/camber, twist, and roll-off. Lapping plates that perform in area 49 have high recession and surface roughness. Lapping plates that perform in area 51 are subject to skidding and/or scratching.

The present invention predicts the lapping property of a lapping plate. The method comprises positioning a tool 11 on a lapping plate 15, rotating the lapping plate 15, and restraining the tool 11 relative to the lapping plate 15. The method also comprises measuring frictional force between the tool 11 and the lapping plate 15 (e.g., with the strain gage 29), measuring a consumption of the tool 11 by the lapping plate 15, and determining a lapping rate of the lapping plate 15.

The method may further comprise rotating the lapping plate 15 for a specific time so that adequate removal of material from the specimen 19 occurs, determining the lapping rate over a time interval, and assessing the lapping rate and friction to determine if the lapping plate 15 is acceptable. The method may further comprise determining the lapping rate under a fixed load (e.g., the weight 35) and a fixed rotation speed, and thereby calculating a coefficient of friction and a Preston coefficient of the lapping plate 15. The assessment need not be invasive, and may comprise detecting the gap distance 33 between the tool 11 and the lapping plate 15. The method also may comprise holding the tool 11 with a set of guide wheels 28 that keep the tool 11 in place when the lapping plate 15 is rotating. In addition, the method may further comprise mounting a plurality of the specimens 19 to the tool for contact with and consumption by the lapping plate 15, and charging the lapping plate 15 with abrasive.

The present invention has several advantages, including the ability to predict the lapping property of a lapping plate. The invention uses samples with a known lap surface and a non-invasive sensor to determine the lapping rate under a fixed load and fixed plate rotation speed. The friction and Preston coefficients of the plate can be calculated under these conditions. The sample may be made from the same material as the lap piece to predict the lapping rate of the plate. The processed plate lapping rate and friction force measurements determine if adequate charging of a plate has been achieved.

While the invention has been shown or described in only some of its forms, it should be apparent to those skilled in the art that it is not so limited, but is susceptible to various changes without departing from the scope of the invention.

What is claimed is:

1. A method of predicting the lapping property of a lapping plate, comprising:

(a) positioning a tool on a lapping plate;

(b) rotating the lapping plate;

(c) restraining the tool relative to the lapping plate;

(d) measuring frictional force between the tool and the lapping plate;

(e) measuring a consumption of the tool by the lapping plate by detecting a gap distance between the tool and the lapping plate; and (f) determining a lapping rate of the lapping plate.

2. The method of claim 1, further comprising rotating the lapping plate for a specific time so that adequate removal of material from the tool occurs, determining the lapping rate over a time interval, and assessing the lapping rate and friction to determine if the lapping plate is acceptable.

3. The method of claim 1, further comprising determining the lapping rate under a fixed load and a fixed rotation speed, and thereby calculating a coefficient of friction and a Preston coefficient of the lapping plate.

4. The method of claim 1, wherein step (e) is non-invasive.

5. The method of claim 1, further comprising charging the lapping plate with abrasive.

6. The method of claim 1, wherein step (d) comprises using a strain gage.

7. A method of predicting the lapping property of a lapping plate, comprising:

(a) positioning a tool on a lapping plate;

(b) rotating the lapping plate;

(c) restraining the tool relative to the lapping plate by holding the tool with a set of guide wheels that keep the tool in place when the lapping plate is rotating;

(d) measuring frictional force between the tool and the lapping plate;

(e) measuring a consumption of the tool by the lapping plate; and (f) determining a lapping rate of the lapping plate.

8. A method of predicting the lapping property of a lapping plate, comprising:

(a) positioning a tool on a lapping plate;

(b) rotating the lapping plate;

(c) restraining the tool relative to the lapping plate;

(d) measuring frictional force between the tool and the lapping plate;

(e) measuring a consumption of the tool by the lapping plate;

(f) determining a lapping rate of the lapping plate; and further comprising adding a weight to the tool so that the tool and the lapping plate experience a pressure that is analogous to a slider lapping pressure.

9. A method of predicting the lapping property of a lapping plate, comprising:

(a) positioning a tool on a lapping plate that is charged with abrasive;

(b) rotating the lapping plate for a specific time to remove material from the tool;

(c) restraining the tool relative to the lapping plate;

(d) measuring frictional force between the tool and the lapping plate;

(e) measuring a consumption of the tool by the lapping plate non-invasively and detecting a gap distance between the tool and the lapping plate; and (f) determining a lapping rate of the lapping plate over a time interval, and assessing the lapping rate and friction to determine if the lapping plate is acceptable, wherein the lapping rate is determined under a fixed load and a fixed rotation speed, and thereby calculating a coefficient of friction and a Preston coefficient of the lapping plate.

10. The method of claim 9, wherein step (d) comprises using a strain gage.

11. A method of predicting the lapping property of a lapping plate, comprising:

(a) positioning a tool on a lapping plate that is charged with abrasive;

(b) rotating the lapping plate for a specific time to remove material from the tool;

(c) restraining the tool relative to the lapping plate by holding the tool with a set of guide wheels that keep the tool in place when the lapping plate is rotating;

(d) measuring frictional force between the tool and the lapping plate;

(e) measuring a consumption of the tool by the lapping plate; and (f) determining a lapping rate of the lapping plate over a time interval, and assessing the lapping rate and friction to determine if the lapping plate is acceptable, wherein the lapping rate is determined under a fixed load and a fixed rotation speed, and thereby calculating a coefficient of friction and a Preston coefficient of the lapping plate.

12. A method of predicting the lapping property of a lapping plate, comprising:

(a) positioning a tool on a lapping plate that is charged with abrasive;

(b) rotating the lapping plate for a specific time to remove material from the tool;

(c) restraining the tool relative to the lapping plate;

(d) measuring frictional force between the tool and the lapping plate;

(e) measuring a consumption of the tool by the lapping plate;

(f) determining a lapping rate of the lapping plate over a time interval, and assessing the lapping rate and friction to determine if the lapping plate is acceptable, wherein the lapping rate is determined under a fixed load and a fixed rotation speed, and thereby calculating a coefficient of friction and a Preston coefficient of the lapping plate; and further comprising adding a weight to the tool so that the tool and the lapping plate experience a pressure that is analogous to a slider lapping pressure.

* * * * *